United States Patent [19]

Whiteman

[11] 3,957,079

[45] May 18, 1976

[54] VALVE ASSEMBLY FOR A SUBSEA WELL CONTROL SYSTEM

[75] Inventor: Jack Whiteman, Houston, Tex.

[73] Assignee: C. Jim Stewart & Stevenson, Inc., Houston, Tex.

[22] Filed: Jan. 6, 1975

[21] Appl. No.: 538,644

[52] U.S. Cl. ..... 137/596.18; 137/608; 137/798; 166/.6

[51] Int. Cl.[2] ..... F15B 13/08

[58] Field of Search ..... 137/596.14, 596.18, 137/608, 798; 166/.6; 285/131

[56] References Cited

UNITED STATES PATENTS

| | | | |
|---|---|---|---|
| 3,460,614 | 8/1969 | Burgess | 137/596.18 X |
| 3,701,549 | 10/1972 | Koomey et al. | 285/131 X |
| 3,760,844 | 9/1973 | Olson et al. | 137/608 |
| 3,840,047 | 10/1974 | Gibbins | 137/608 |

*Primary Examiner*—Alan Cohan
*Assistant Examiner*—Gerald A. Michalsky
*Attorney, Agent, or Firm*—Fulbright & Jaworski

[57] ABSTRACT

A valve assembly for controlling the flow of hydraulic fluid through a subsea control system providing hydraulic control of underwater equipment and having a female member adapted to be connected to the underwater equipment and having a retrievable male member coacting with the female member in which each of said members includes a plurality of flow control passageways. A laminated manifold block having top, middle and lower layers is connected to the top of the male member and supports a plurality of individual valve housings releasably secured to the top layer of the manifold block for receiving control valves. The laminated manifold block includes fluid supply, fluid exhaust and fluid outlet passageways between the control valves and the controlled underwater equipment. The laminated manifold block is longer than the width of the male member thereby accommodating larger control valves to provide an adequate volume of fluid for control purposes. The manifold block may include a plurality of separate fluid supply manifolds for controlling different underwater equipment requiring different actuating pressures.

8 Claims, 4 Drawing Figures

VALVE ASSEMBLY FOR A SUBSEA WELL CONTROL SYSTEM

BACKGROUND OF THE INVENTION

It is old, as shown in U.S. Pat. Nos. 3,460,614 and 3,701,549, to provide a valve assembly for use in a subsea well control system. However, in prior art devices valve pockets were drilled into a solid circular valve block, which was difficult to machine, extremely bulky, and required replacement of the entire unit if one of the pockets became damaged. Additionally, while the valve assemblies of the prior art were generally satisfactory for controlling a minimum number of underwater functions, subsea well control systems now control up to sixty four functions and require larger fluid passageways and valves for satisfactorily operating the underwater equipment, which cannot be accomplished in the prior art devices.

The present invention is directed to various improvements in a valve assembly for controlling flow of hydraulic fluid through the control passageways of a subsea control system.

SUMMARY

The present invention is directed to an improved valve assembly having a laminated manifold block having top, middle and lower layers and which is adapted to be connected to a subsea control system for providing hydraulic control of underwater equipment in which a female member is adapted to be connected to the underwater equipment and has a retrievable male member coacting with the female member with said members having a plurality of fluid control passageways therethrough. The laminated manifold block of the present invention is adapted to be connected to the top of the male member. The laminated valve block supports a plurality of individual valve housings which are releasably secured to the top layer of the valve block, each of which is adapted to receive a pilot operated control valve having an inlet, an outlet and a vent port. The laminated manifold block includes fluid supply, fluid exhaust and fluid outlet passageways extending between the control valves and the male member for hydraulically controlling the underwater equipment connected to the subsea system.

A still further object of the present invention is the provision of a laminated manifold block being rectangular and being longer than the width of the male member of the subsea control system for accommodating valves of adequate size to provide the volume of hydraulic fluid necessary to control the underwater equipment while allowing the male and female control members to be of a minimum size and allowing the manifold to be a minimum size.

Still a further object of the present invention is the provision of an improvement in the valve assembly for a subsea control system having a laminated manifold block which provides the tortuous routes between a plurality of control valves and the male member of the subsea control system which could not be obtained by straight line drilling with conventional machining.

Still a further object of the present invention is the provision of providing a plurality of individual valve housings which are releasably secured to the top layer of the laminated manifold block which are easily connected to and replaced from the manifold block and may be replaced on an individual basis when required.

Yet a still further object of the present invention is the provision of a valve assembly for a subsea control system having a laminated manifold block having top, middle and lower layers in which a plurality of outlet passageways extend through the top, middle and lower layers of the valve block to provide communication between one of the outlets of one of the control valves and one of the fluid passageways in the male member in which the outlet passageways in the top layer are positioned in a plurality of longitudinally and transversely extending lines to provide an optimum positioning of the internal passageways in the valve manifold, and at the same time reducing the size required to a minimum.

Yet a still further object of the present invention is the provision of providing a plurality of separate fluid supply manifolds in the middle layer of the laminated valve manifold which extend through the top layer to different control valve inlets for controlling different underwater equipment having different actuating pressures.

Still a further object of the present invention is the provision of providing a fluid exhaust manifold in the middle layer of the laminated valve manifold which extends through the top layer to each of the outlet ports of the control valve.

A still further object of the present invention is the provision of extending the fluid supply manifold and fluid exhaust manifold to the top layer of the laminated valve manifold at points offset from the longitudinally and transversely extending lines of the outlet passageways for optimizing the space and strength requirements of the manifold.

A still further object of the present invention is the provision of a common fluid exhaust manifold in the lower layer of the valve manifold connected to a plurality of separate exhaust manifolds in the middle layer of the valve manifold.

Yet a still further object of the present invention is the provision of a plurality of fluid control passageways in the male member at the top of the male member positioned in concentric circles and the outlet passageways in the laminated valve manifold extend vertically through the top layer and middle layer to the lower layer and extend horizontally through the lower layer to one of the fluid control passageways in the male member.

Other and further objects, features and advantages will be apparent from the following description of a presently preferred embodiment of the invention, given for the purpose of disclosure and taken in conjunction with the accompanying drawings.

BRIEF DESCRIPTION OF THE PREFERRED EMBODIMENT

Figure 1:
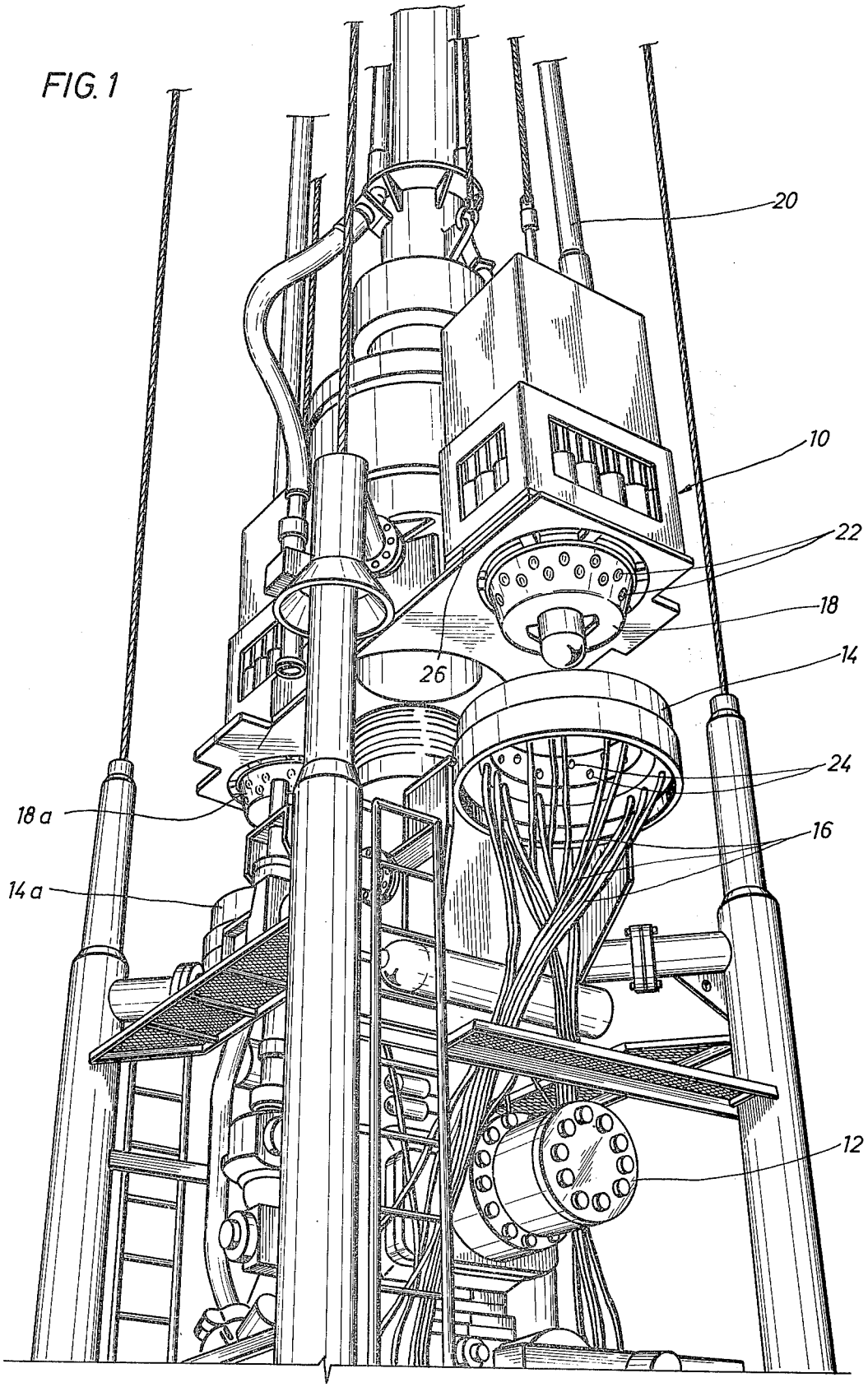
FIG. 1 is a fragmentary perspective view of the valve assembly of the present invention in use in a subsea control system providing hydraulic control of underwater equipment.

Referring now to FIG. 1, a subsea well control system generally indicated by the reference numeral 10 is shown which provides hydraulic control of various underwater equipment, such as a blowout preventer 12, in a subsea well. The well control system 10 generally includes one or more female members 14 and 14*a* adapted to be connected to the underwater equipment 12 by a plurality of fluid control conduits 16, and one or more male members 18 and 18*a* which are retrievable and adapted to coact with the female members 14 and 14*a*, respectively, and are in turn connected through a valve assembly to a control cable 20 and 20*a* through which a hydraulic supply conduit and a plurality of electrical and/or hydraulic controls are provided. The male member 18 includes a plurality of fluid passageways 22 which mate with a plurality of fluid passageways 24 in the female member 14 when the male member 18 is connected to the female member 14. Subsea control well systems for hydraulically controlling underwater well equipment is generally shown in U.S. Pat. Nos. 3,460,614 and 3,701,549.

However, as drilling equipment has become increasingly more complex, the underwater control systems 10 are increasingly required to control more and more of various types of well equipment with greater efficiency, but with a minimum size. For example only, the present system is designed to control sixty-four well functions. In addition, in order to obtain a fast response time for operation of the underwater equipment, the hydraulic passageways must be increased in size to handle an increased volume of control fluid. While the number and sizes of the fluid passageways 22 and 24 in the male member 18 and the female member 14, respectively, can satisfactorily be increased by machining more and a larger number of passageways 22 and 24, the increase of size and number of controls cannot be satisfactorily controlled by the conventional valve block of the prior art. For example, increasing the number and size of the control valves and placing them in a machined valve pocket, as shown in the prior art, creates a difficult machining operation and unduly increases the size not only of the valve block but of the male and female members in order to obtain coaxial registry of the machine pockets with the fluid passageways 22 in the male member 18. Furthermore, since the machined pockets must be machined to close tolerances to fit with the control valves, errors in machining of the pocket requires that the entire valve block be scrapped.

Figure 2:
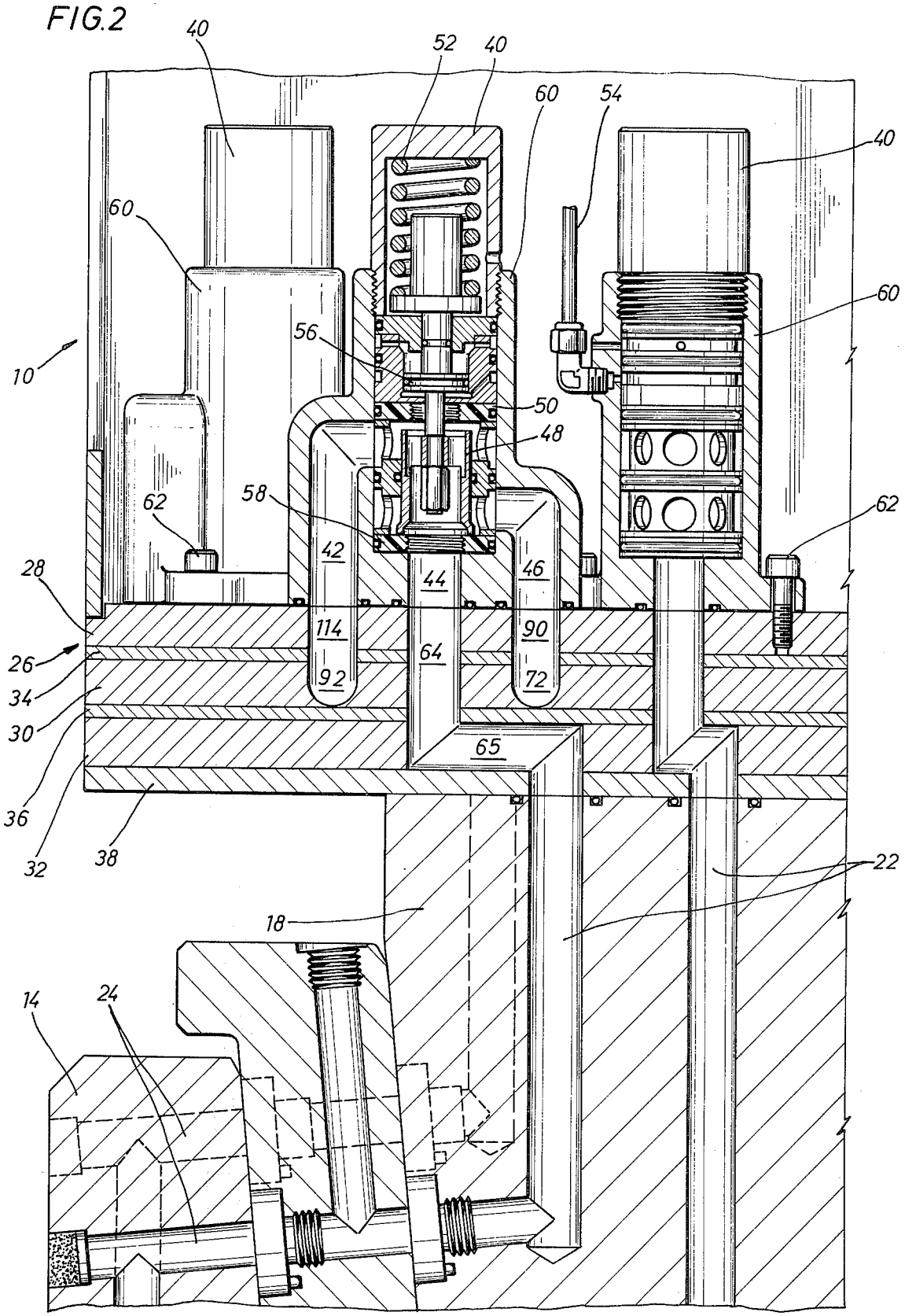
FIG. 2 is a fragmentary elevational view, partly in cross section, taken along line 2—2 of FIG. 3, of a portion of a valve assembly of the present invention controlling the passage of hydraulic fluid through the male and female members of the subsea control system.
Figure 3:
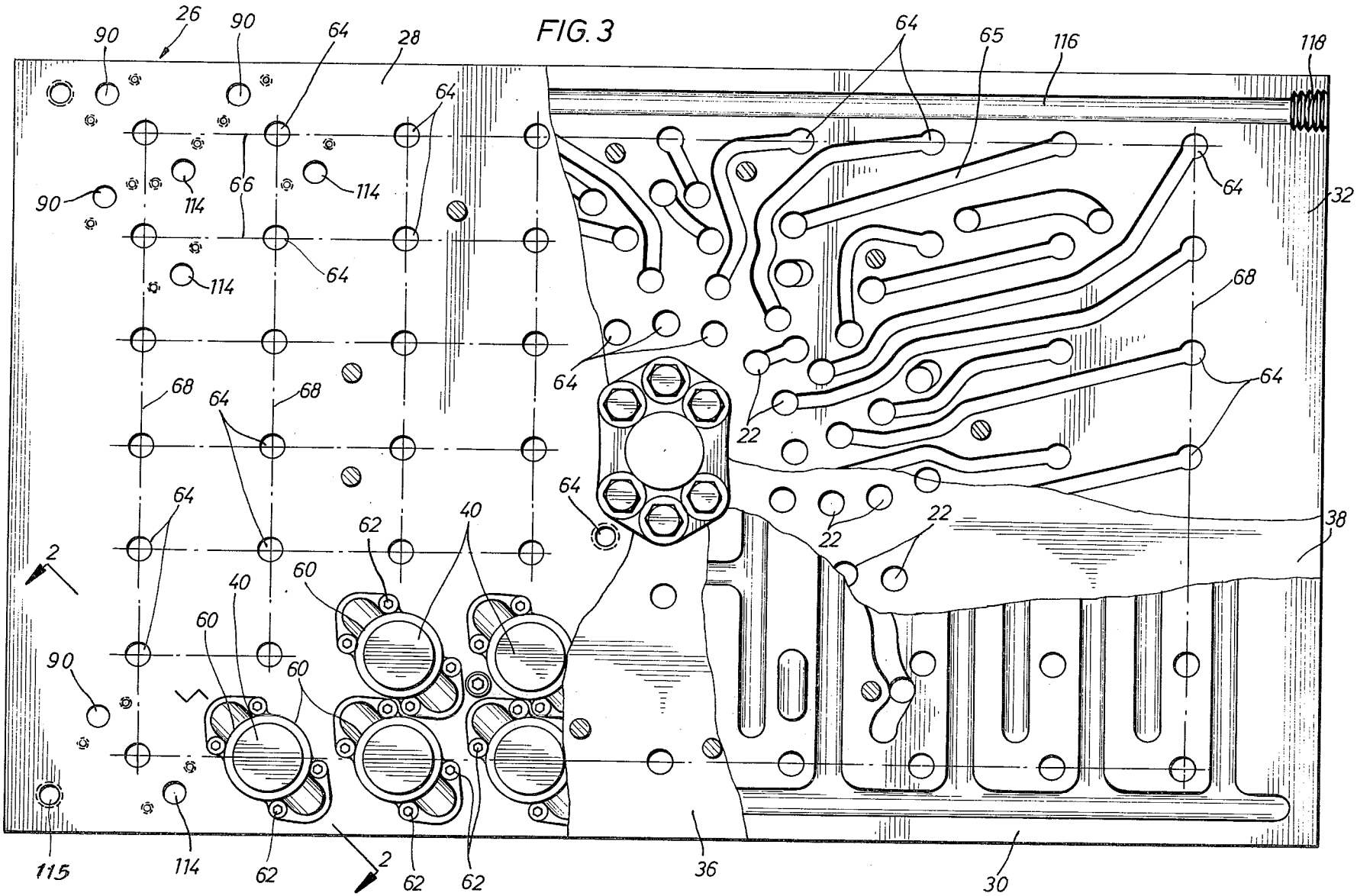
FIG. 3 is a fragmentary elevational view of the laminated valve manifold cut away at various levels to show the internal passageways at different layers of the valve manifold.

The present invention is directed to the provision of a laminated manifold block generally indicated by the reference numeral 26, as best seen in FIGS. 2 and 3, having a top layer 28, a middle layer 30 and a lower layer 32 in which interface layers 34, 36 and 38 may be provided. The use of a laminated manifold block allows each of the layers to be made separately to provide complicated fluid flow channels therein, which could not be accomplished in a unitary valve block as used in the prior art, and the layers are then assembled and conventionally laminated together. The manifold block 26 is suitably connected to the top of the male member 18, such as by bolts. Preferably, the manifold block 26 is of a rectangular shape and of a length wider than the width of the male member 18 to accommodate the increased size of the control passageways desired, but allow the size of the male member 18, the female member 14 and the manifold 26 to be kept to a minimum and provides a more compact device than the circular valve blocks of the prior art.

A plurality of pilot operated control valves 40, such as model No. SPM control valve No. 10-05025 as sold by C. Jim Stewart & Stevenson, Inc. of Houston, Tex., may be provided, each of which of which has an inlet port 42, an outlet port 44 and a vent or discharge port 46. The valves 40 include a valve element 48 yieldably urged to seat against a valve seat 58 by a spring 52 to provide communication between the outlet 44 and the inlet port 42. A pilot control line 54 is connected to the valve 40 so as to move a piston 56 connected to the valve element 48 upwardly to seat the valve element 48 against a second seat 50 to provide communication betwen the outlet port 44 and the vent port 46 while blocking the inlet port 42.

A plurality of individual valve housings 60 are releasably secured to the top layer 28 of the manifold block 26, such as by bolts 62, and each of the housings 60 receives one of the control valves 40. The individual housing 60 may be easily repaired or replaced in the event of a failure without requiring scrapping of the entire valve block 26 in the event of tolerance problems with the valves 40, the individual housings 60 may be individually machined as required, only the required number need be used with blanking plates installed if a valve is not required, the individual housings can be made of different materials, and since the housings are symmetrical, either normally opened or normally closed valves can be used.

Referring still to FIGS. 2 and 3, a plurality of outlet passageways 64 extend through the top layer 28, the middle layer 30 and the lower layer 32 of the laminated manifold block 26 to provide communication between one of the outlets 44 of one of the control valves 40 and one of the fluid passageways 22 in the male member 18. Preferably, for providing minimum size with the necessary strength to satisfy the pressure requirements and to provide spacings for other passageways, the majority of the outlet passageways 64 are positioned in the top layer 28 positioned in a plurality of longitudinal lines 66 and transversely extending line 68, with the exception of four outlet passageways 64 positioned adjacent the center of the manifold block 26.

Figure 4:
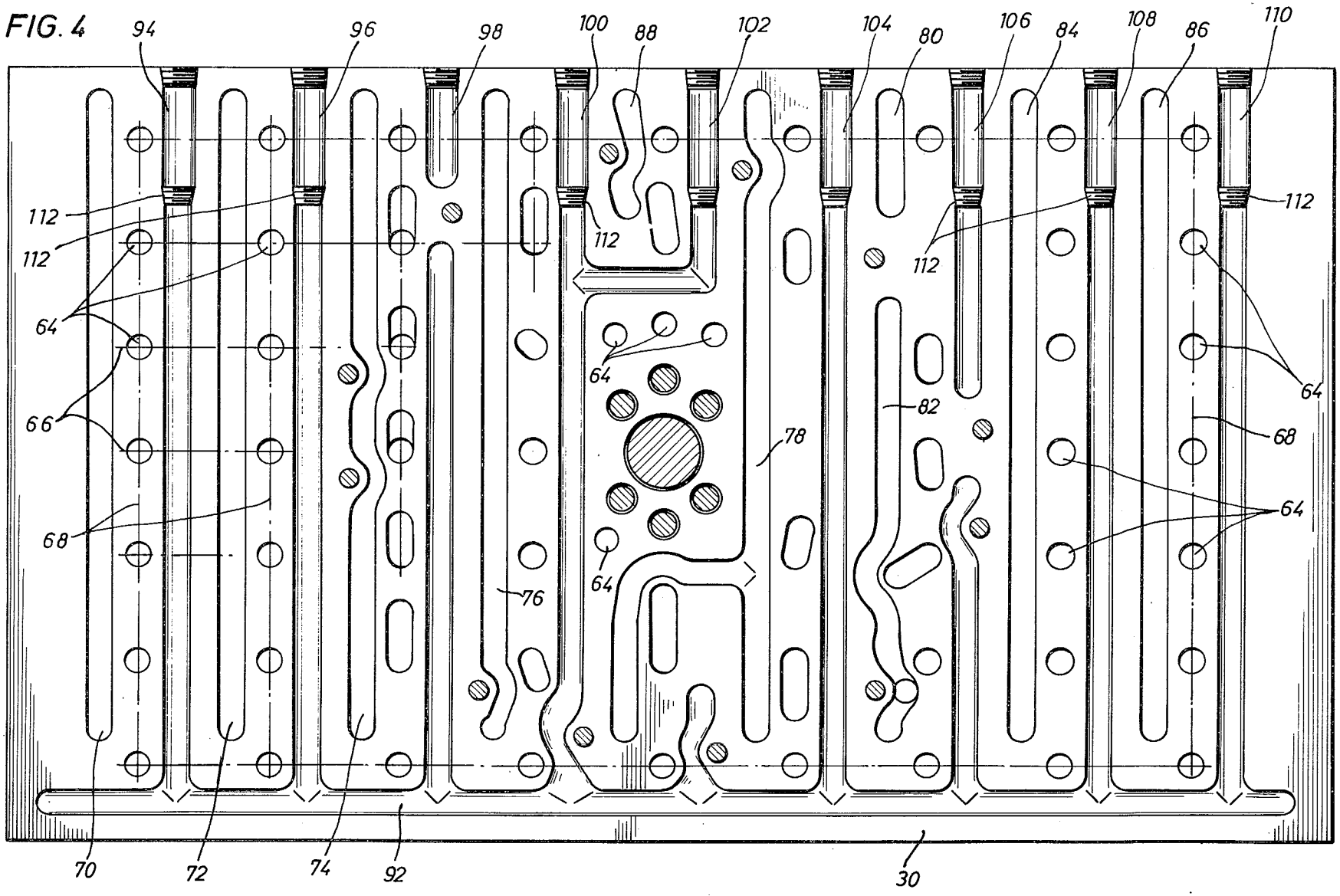
FIG. 4 is an elevational view of the middle layer of the laminated valve manifold of the present invention.

The middle layer 30 of the laminated manifold block 26 includes at least one fluid exhaust manifold, and preferably, as best seen in FIG. 4, a plurality of separate fluid exhaust manifolds 70, 72, 74, 76, 78, 80, 82, 84 and 86 and 88. Each of the exhaust manifolds 70–88 includes vertical passageways 90 (FIG. 2) extending upwardly through the top layer 28 of the laminated manifold block 26 to each of the outlet ports 46 of the control valves 40.

The middle layer 30 of the laminated manifold block 26 also includes a fluid supply manifold, preferably a plurality of separate supply manifolds 92, 94, 96, 98, 100, 102, 104, 106, 108 and 110. Manifolds 94, 96, 100, 102, 104, 106, 108 and 110 may be separated from manifold 92 by a plurality of plugs 112 to provide separate pressure supply manifolds for controlling the different underwater equipment having different actuating pressures. Of course, the plugs 112 may be omitted depending upon the number of different hydraulic pressure systems required to be controlled by the valve assembly. Each of the supply manifolds 92–110 include a passageway 114 extending through the top layer 28 to the inlet 42 of each of the control valves 40.

It is generally noted from FIG. 4 that the exhaust manifolds 70–88 and the fluid supply manifolds 92–110 include portions generally extending transversely or parallel to the longitudinal lines 68 along which the outlet passageways 64 are positioned. However, as best seen from FIG. 3, the valves 40 are preferably positioned at a 45° angle to the transverse lines 68 on layer 28 and thus the fluid exhaust passageways 90 and the fluid supply passageways 114 extend through the top layer 28 of the manifold block 26 at points offset from the longitudinal and transversely extending lines 66 and 68, respectively, for again reducing the size of the valve block 26 but still providing adequate strength to withstand the pressures within the block 26.

While each of the separate supply manifolds 94, 96, 98, 100, 102, 104, 106, 108 and 110 may be connected to separate fluid supply lines at layer 30, the fluid supply manifold 92 may be supplied through a port 115 (FIG. 3) in the upper layer 28.

However, referring to FIG. 3, in order to avoid a plurality of separate exhaust exits from the fluid exhaust manifolds 70–88, an exhaust exit manifold 116 may be provided in the lower layer 32 communicating with each of the fluid exhaust manifolds 70–88 in the middle layer 30 and exhaust from port 118 to the sea or to a suitable return line. Thus, the valve assembly of the present invention may provide a closed exhaust which may be captured and returned instead of sprayed through the valves as shown in the prior art.

As best seen in FIG. 3, and referring to layers 32 and 38, it is perceived that the male member 18 has a plurality of fluid passageways 22, for example in the present embodiment sixty-four which are positioned in four concentric rows of sixteen fluid passageways each. As previously noted, the outlet passageways 64 extending from the outlet 44 of the control valves 40 through the top layer 28, the middle layer 30 and to the lower layer 32, are vertical. In the lower layer 32 however, the passageways 64 since they are positioned in longitudinally and transversely lines 66 and 68 will not match up with the circularly spaced fluid passageways 22 in the male member 18. Therefore, as best seen in FIGS. 2 and 3, the lower layer 32 includes fluid passageways 65 forming part of the outlet passageways 64 which extend from the vertical portion of the passageway 64 to a point adjacent one of the fluid passageways 22 in the male member 18.

The laminated valve manifold 26 of the present invention provides a valve assembly in which the valve housings 60 and valves 40 may be easily repaired or replaced, the fluid passageways may be sized large enough to provide the necessary volume of fluid required to quickly actuate the well equipment without unduly increasing the size of the male and female members, a captured exhaust is provided, and separate fluid supply manifolds are provided to allow separate pressure supply systems for different well equipment.

The present invention, therefore, is well adapted to carry out the objects and attain the ends and advantages mentioned as well as others inherent therein. While a presently preferred embodiment of the invention has been given for the purpose of disclosure, numerous changes may be made without departing from the spirit and scope of the invention as hereinafter claimed.

What is claimed is:

1. In a subsea control system for providing hydraulic control of underwater equipment and having a female member adapted to be connected to the underwater equipment and having a retrievable male member coacting with the female member, said male and female members each including a plurality of fluid control passageways therethrough, the improvement in a valve assembly for controlling the flow of hydraulic fluid through the control passageways comprising, a plurality of pilot operated control valves each having an inlet, an outlet, and a vent port, a laminated manifold block having top, middle and lower layers, said valve block being connected to the top of the male member, a plurality of individual valve housings releasably secured to the top layer of the manifold block for receiving said control valves, each of said housings having a pilot control line connection, a plurality of outlet passageways extending through the top, middle and lower layers of the manifold block providing communication between one of the outlets of one of the control valves and one of the fluid passageways in the male member, said middle layer of the manifold block including a fluid supply manifold which extends through the top layer to each of the inlet ports of the control valves, and said middle layer of the manifold block including a fluid exhaust manifold which extends through the top layer to each of the vent ports of the control valves.

2. The apparatus of claim 1 wherein the laminated valve block is rectangular in shape and longer than the width of the male member for accommodating said valves.

3. The apparatus of claim 1 wherein the middle layer of the valve block includes a plurality of separate fluid supply manifolds which extend through the top layer to different control valves for controlling different underwater equipment having different actuating pressures.

4. The apparatus of claim 1 wherein the outlet passageways in the top layer of the valve manifold are positioned in a plurality of longitudinally and transversely extending lines, and said fluid supply manifold and said fluid exhaust manifold extend through the top layer of the manifold block at points offset from said longitudinally and transversely extending lines.

5. The apparatus of claim 4 wherein the fluid control passageways in the male member at the top of the male member are positioned in a plurality of concentric circles, and the outlet passageways in the top layer extend vertically through the middle layer to the lower layer and extend through the lower layer to one of the fluid control passageways in the male member.

6. The apparatus of claim 1 wherein the fluid exhaust manifold in the middle layer includes a plurality of separate manifolds, and the lower layer of the manifold block includes a second fluid exhaust manifold connected to each of the separate manifolds in the middle layer.

7. The apparatus of claim 1 wherein the fluid control passageways in the male member at the top of the male member are positioned in a plurality of concentric circles, and the outlet passageways in the top layer extend vertically through the middle layer to the lower layer and extend transversely through the lower layer to one of the fluid control passageways in the male member.

8. In a subsea control system for providing hydraulic control of underwater equipment and having a female member adapted to be connected to the underwater equipment and having a retrievable male member coacting with the female member, said male and female members each including a plurality of fluid control passageways therethrough, the improvement in a valve assembly for controlling the flow of hydraulic fluid through the control passageways comprising, a plurality of pilot operated control valves each having an inlet, an outlet, and a vent port, a laminated manifold block having top, middle, and lower layers, said valve manifold being connected to the top of the male member and extending beyond the top of the male member for accommodating said valves, a plurality of individual valve housings releasably secured to the top layer of the valve manifold for receiving said control valves, each of said housings having a pilot line connection, a plurality of outlet passageways extending through the top, middle and lower layers of the valve manifold providing communication between one of the outlets of one of the control valves and one of the fluid passageways in the male member, said outlet passageways in the top layer being positioned in a plurality of longitudinally and transversely extending lines, said middle layer of the valve manifold including a plurality of separate fluid supply manifolds which extend through the top layer to different control valve inlets for controlling different underwater equipment having different actuating pressures, said middle layer of the valve manifold including a plurality of separate fluid exhaust manifolds which extend through the top layer to one of the vent ports of the control valves, said fluid supply manifold and said fluid exhaust manifold extending through the top layer of the valve manifold at points offset from said longitudinally and transversely extending lines of the outlet passageways, and the lower layer of the valve manifold includes another fluid exhaust manifold connected to each of the separate exhaust manifolds in the middle layer.

* * * * *